US007163449B2

(12) United States Patent
Davis

(10) Patent No.: US 7,163,449 B2
(45) Date of Patent: Jan. 16, 2007

(54) HAND HELD ABRASIVE BLASTER

(75) Inventor: Jamie Davis, Sherwood Park (CA)

(73) Assignee: High Production Inc., Sherwood Park (CA)

( * ) Notice: Subject to any disclaimer, the term of this patent is extended or adjusted under 35 U.S.C. 154(b) by 18 days.

(21) Appl. No.: 11/166,399

(22) Filed: Jun. 24, 2005

(65) Prior Publication Data

US 2006/0276112 A1 Dec. 7, 2006

(30) Foreign Application Priority Data

Apr. 4, 2005 (CA) ..... 2505066

(51) Int. Cl.
*B24C 3/06* (2006.01)

(52) U.S. Cl. ..... 451/90; 451/38; 451/75; 451/101; 451/39

(58) Field of Classification Search ..... 451/90, 451/96, 101, 102; 277/370, 371, 375, 511, 277/551
See application file for complete search history.

(56) References Cited

U.S. PATENT DOCUMENTS 2,755,598 A 7/1956 Van Denburgh
4,139,970 A 2/1979 Hockett
4,545,156 A 10/1985 Hockett
4,825,598 A 5/1989 Schlick
5,058,688 A * 10/1991 Scott et al. ..... 175/20
5,199,228 A 4/1993 Beausoleil
5,209,409 A * 5/1993 Neiss ..... 239/586
5,489,234 A 2/1996 Hockett
5,536,200 A * 7/1996 Kiess ..... 451/102
5,551,909 A * 9/1996 Bailey ..... 451/75
5,558,562 A * 9/1996 Diat ..... 451/38
5,582,537 A * 12/1996 Keller ..... 451/76
5,605,496 A * 2/1997 Pickard ..... 451/90
5,688,323 A 11/1997 Kane et al.
5,775,979 A 7/1998 Coke et al.
5,795,214 A * 8/1998 Leon ..... 451/102
5,795,626 A * 8/1998 Gabel et al. ..... 427/458
5,816,505 A 10/1998 Tran et al.
5,857,900 A * 1/1999 Shank, Jr. ..... 451/102
5,876,267 A * 3/1999 Kanda ..... 451/38
5,927,722 A * 7/1999 Carmody et al. ..... 277/368
5,947,800 A * 9/1999 Fring ..... 451/99
6,062,957 A 5/2000 Klaft et al.
6,089,531 A * 7/2000 Young ..... 251/61.4
6,106,377 A * 8/2000 Chu et al. ..... 451/102
6,149,509 A * 11/2000 Bruns et al. ..... 451/90
6,168,503 B1 * 1/2001 Pao et al. ..... 451/40

(Continued)

FOREIGN PATENT DOCUMENTS

CA 2 421 806 9/2004

(Continued)

*Primary Examiner*—David B. Thomas
*Assistant Examiner*—Robert Scruggs
(74) *Attorney, Agent, or Firm*—Davis & Bujold, P.L.L.C.

(57) ABSTRACT

A hand held abrasive blaster includes a tubular wand housing and an abrasives conduit which extends into the wand housing. The abrasives conduit includes a fixed portion at the rearward end and a rotatable portion at the forward end. A motor rotates the rotatable portion. A pair of spaced apart handles on the exterior surface of the wand housing. The handles are positioned along the exterior of the wand housing at a center of gravity for the wand housing.

3 Claims, 7 Drawing Sheets

U.S. PATENT DOCUMENTS 6,254,366 B1 * 7/2001 Walton et al. ..... 418/114
6,315,648 B1 11/2001 Neer
6,383,062 B1 * 5/2002 Jou ..... 451/90
6,439,966 B1 * 8/2002 Bruns et al. ..... 451/38
6,447,377 B1 * 9/2002 Londenberg et al. ..... 451/90
6,634,570 B1 * 10/2003 Scherer ..... 239/117
2003/0037654 A1 * 2/2003 Sciulli et al. ..... 83/177
2005/0061499 A1 * 3/2005 Hopper ..... 166/84.3

FOREIGN PATENT DOCUMENTS

DE 8 808 550 11/1989
FR 2 684 900 6/1993

* cited by examiner

DETAIL A

HAND HELD ABRASIVE BLASTER

This application claims priority from Canadian Application Serial No. 2505066, filed Apr. 4, 2005.

FIELD OF THE INVENTION

The present invention relates to a hand held abrasive blaster.

BACKGROUND OF THE INVENTION

Canadian patent application 2,421,806 discloses an abrasive blaster, which is capable of covering a larger surface area with abrasive shot than is possible with a conventional nozzle. This is made possible by a rotating shaft with diverging outlet nozzles, which causes a vortex effect as shot leaves the nozzles. When a need arose for a hand held abrasive blaster, an attempt was made to reduce the size of the abrasive blaster illustrated and described in Canadian patent application 2,421,806. It became apparent that a different configuration would be needed for a hand held abrasive blaster.

SUMMARY OF THE INVENTION

According to the present invention there is provided a hand held abrasive blaster which includes a tubular wand housing having a forward end, a rearward end, an exterior surface, and an interior surface defining an interior bore. An abrasives conduit extends into the wand housing. The abrasives conduit has a forward end, a rearward end, a fixed portion at the rearward end and a rotatable portion at the forward end. The fixed portion has an exterior surface, an interior surface defining a first interior bore, a rearward hose attachment end, and a forwardly projecting end. The rotatable portion telescopically overlies the forwardly projecting end of the fixed portion. The rotatable portion has an exterior surface, an interior surface defining a second interior bore co-axial with the first interior bore, an overlying rearward end and a forward nozzle end. Bearings are disposed between the exterior surface of the fixed portion of the abrasives conduit and the interior surface of the rotatable portion of the abrasives conduit. A seal is disposed at the transition between the forwardly projecting end of the fixed portion of the abrasives conduit and the rotatable portion. Diverging nozzles are positioned at the forward nozzle end of the rotatable portion of the abrasives conduit. A hose connection adapted for connecting the abrasives conduit to a source of abrasives under pressure is positioned at the rearward hose attachment end of the fixed portion of the abrasives conduit. A motor is mounted in parallel spaced relation to the rearward end of the abrasives conduit. The motor has a driving gear that engages a driven gear positioned around the circumference of the exterior surface of the overlying rearward end of the rotatable portion the abrasives conduit. The driving gear of the motor imparts a motion to the driven gear to rotate the rotatable portion of the abrasives conduit within the wand housing. A pair of spaced apart handles on the exterior surface of the wand housing. The handles are positioned along the exterior of the wand housing at a centre of gravity for the wand housing. Weight provided by the motor at the second end of the wand housing is counter-balance by weight provided by that portion of the wand housing extending forward of the handles.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
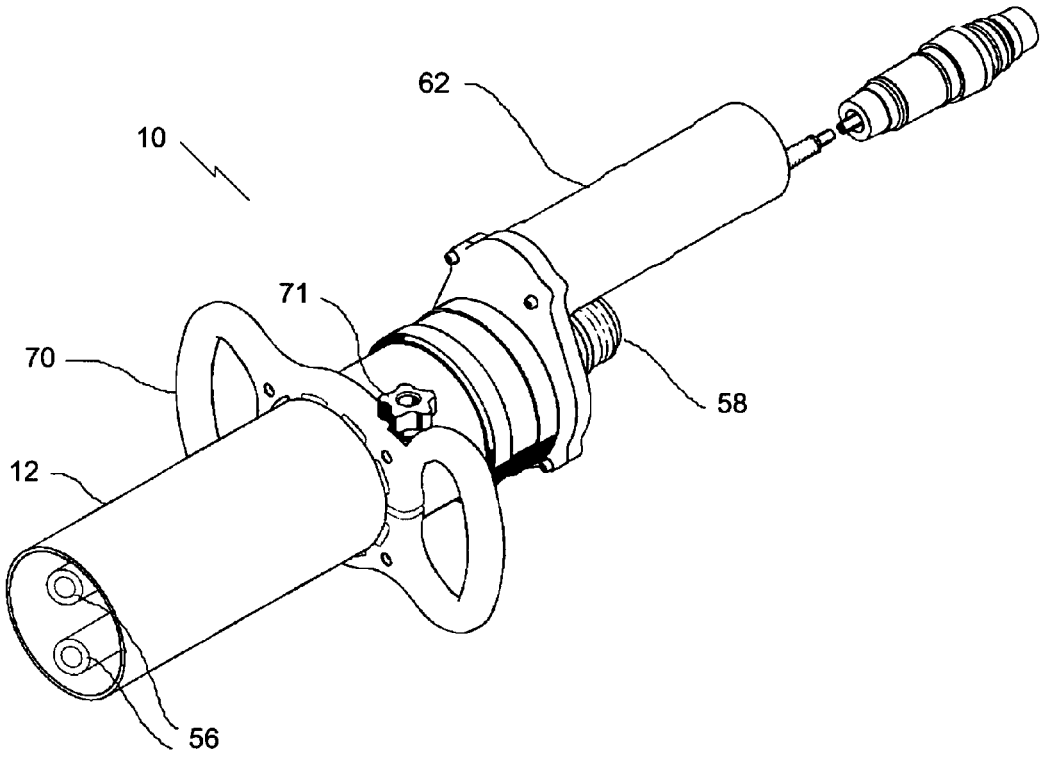
FIG. 1 is a perspective view of a hand held abrasive blaster constructed in accordance with the present invention.

The preferred embodiment, a hand held abrasive blaster generally identified by reference numeral 10, will now be described with reference to FIGS. 1 through 6.

Figure 2:
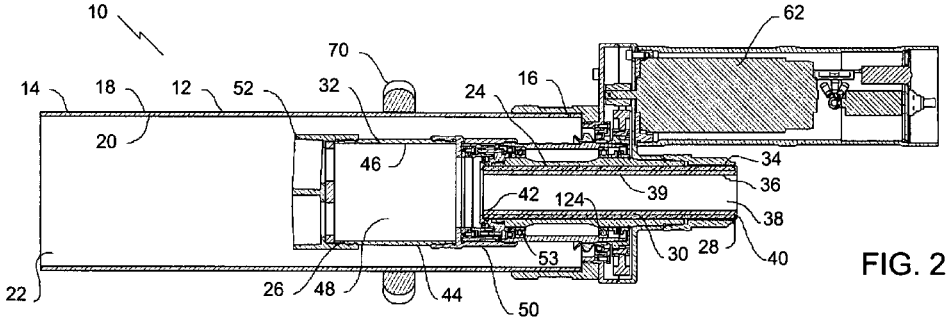
FIG. 2 is a side elevation view in section of a hand held abrasive blaster of FIG. 1. with diverging nozzles removed.
Figure 3:
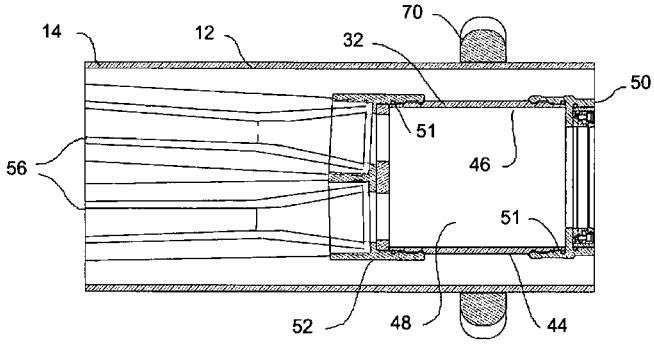
FIG. 3 is a detailed side elevation view, in section, of the forward end of the housing of the hand held abrasive blaster of FIG. 1, including the diverging nozzles.
Figure 4:
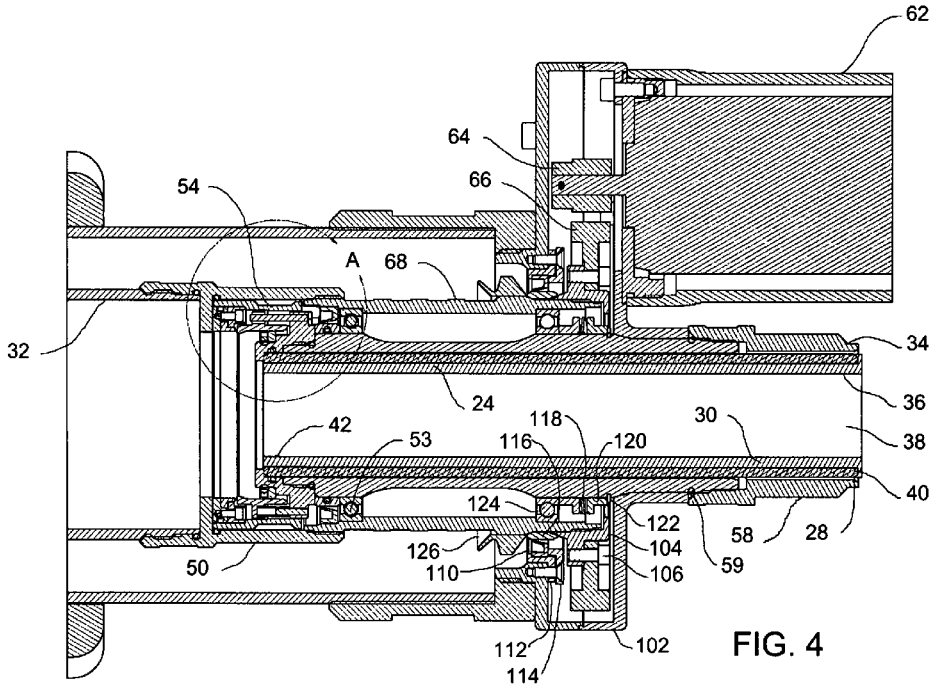
FIG. 4 is a detailed side elevation view, in section, of the rearward end of the housing of the hand held abrasive blaster of FIG. 1.

Structure and Relationship of Parts:

Referring to FIG. 2, hand held abrasive blaster 10 includes a tubular wand housing 12 that has a forward end 14, a rearward end 16, an exterior surface 18, and an interior surface 20 defining an interior bore 22. An abrasives conduit 24 extends into wand housing 12 and has a forward end 26 and a rearward end 28. Abrasives conduit 24 has a fixed portion 30 at rearward end 28 and a rotatable portion 32 at forward end 26. Fixed portion 30 has an exterior surface 34, an interior surface 36 defining a first interior bore 38, a liner 39, a rearward hose attachment end 40, and a forwardly projecting end 42. Rotatable portion 32 telescopically overlies forwardly projecting end 42 of fixed portion 30 and has an exterior surface 44, an interior surface 46, an overlying rearward end 50 and a forward nozzle end 52. Referring to FIG. 3, for ease of assembly, rotatable portion 32 is made in several coupled sections with o-ring seals 51 used to seal between the sections. Interior surface 46 defines a second interior bore 48 that is co-axial with first interior bore 38. Bearings 53 are disposed between exterior surface 34 of fixed portion 30 of abrasives conduit 24 and interior surface 46 of rotatable portion 32 of abrasives conduit 24. Referring to FIG. 4, a seal, such as a replaceable seal cartridge 54, is disposed at the transition between forwardly projecting end 42 of fixed portion 30 of abrasives conduit 24 and rotatable portion 32. Referring to FIG. 3, diverging nozzles 56 are positioned at forward nozzle end 52 of rotatable portion 32 of the abrasives conduit 24. Referring to FIG. 4, a hose connection 58 is adapted for connecting abrasives conduit 24 to a source of abrasives (not shown) under pressure positioned at rearward hose attachment end 40 of fixed portion 30 of abrasives conduit 24. An o-ring 59 helps secure hose connection 58 to abrasives conduit 24.

Referring again to FIG. 4, a motor 62 is mounted in parallel spaced relation to rearward end 28 of abrasives conduit 24. Motor 62 has a driving gear 64 that engages a driven gear 66 that is positioned around the circumference of the exterior surface 68 of overlying rearward end 50 of rotatable portion 32 of abrasives conduit 24, such that driving gear 64 of motor 62 imparts a motion to driven gear 66 to rotate rotatable portion 32 of abrasives conduit 24 within wand housing 12. A gearbox 102 contains driving gear 64 and driven gear 66. Inside gearbox 102 is a gear mount hub 104, screws 106 for securing driven gear 66, and a gearbox seal 110, including a seal housing 112, seal retainer 114, and seal wear sleeve 116. A spring 118 and secondary spring bearing spacer 120, held in place by retainer ring 122, keep rearmost bearings 124 in position. A v-ring 126 is located outside gearbox 102.

Referring to FIG. 1, there is a pair of spaced apart handles 70 on exterior surface 18 of wand housing 12 positioned along the exterior of wand housing 12 at a centre of gravity for wand housing 12, such that weight provided by motor 62 at rearward end 16 of wand housing 12 is counter-balance by weight provided by that portion of wand housing 12 extending forward of handles 70. The position of handles 70 may be moved by loosening them by turning knob 71. Handles 70 may then be moved to the appropriate position, and tightened into place again.

Figure 5:
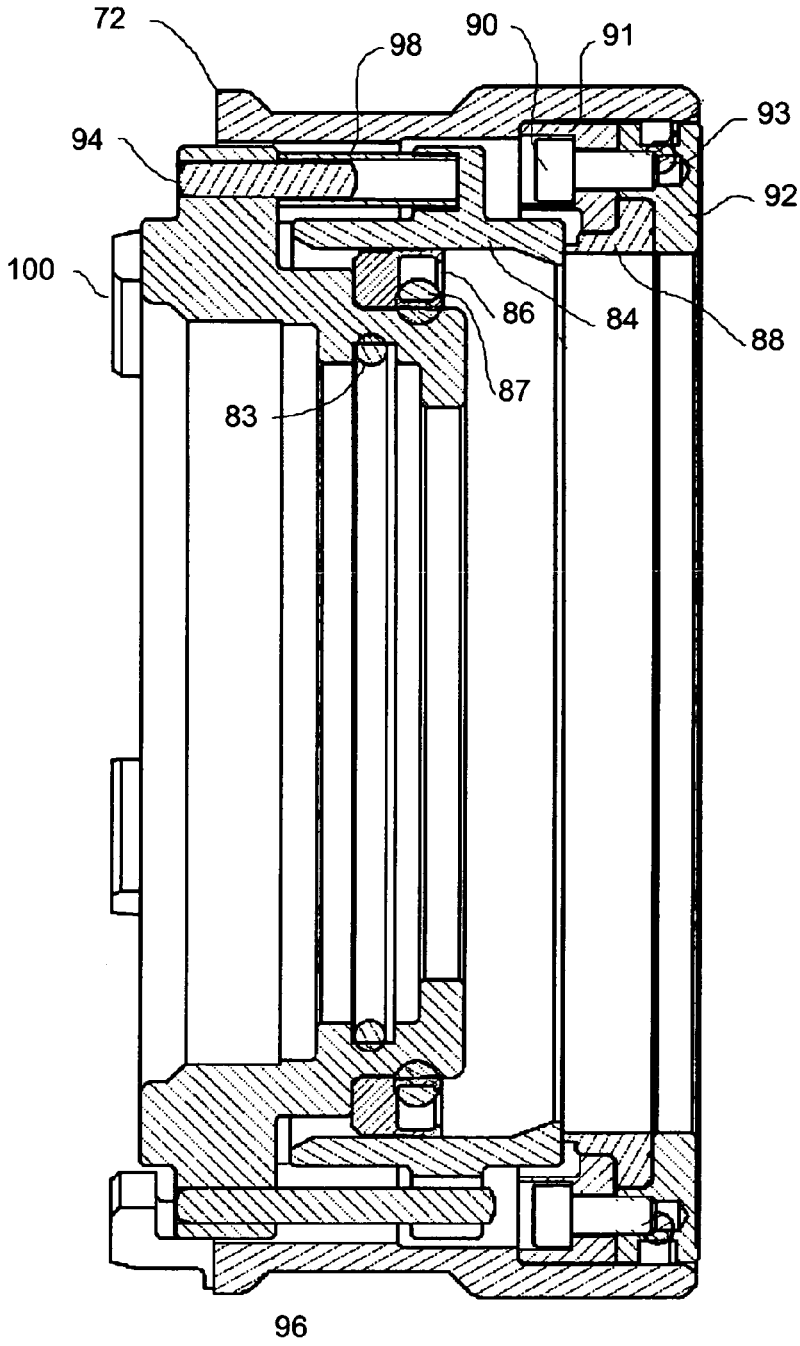
FIG. 5 is a side elevation view in section of the seal cartridge, illustrated in FIG. 2.
Figure 6:
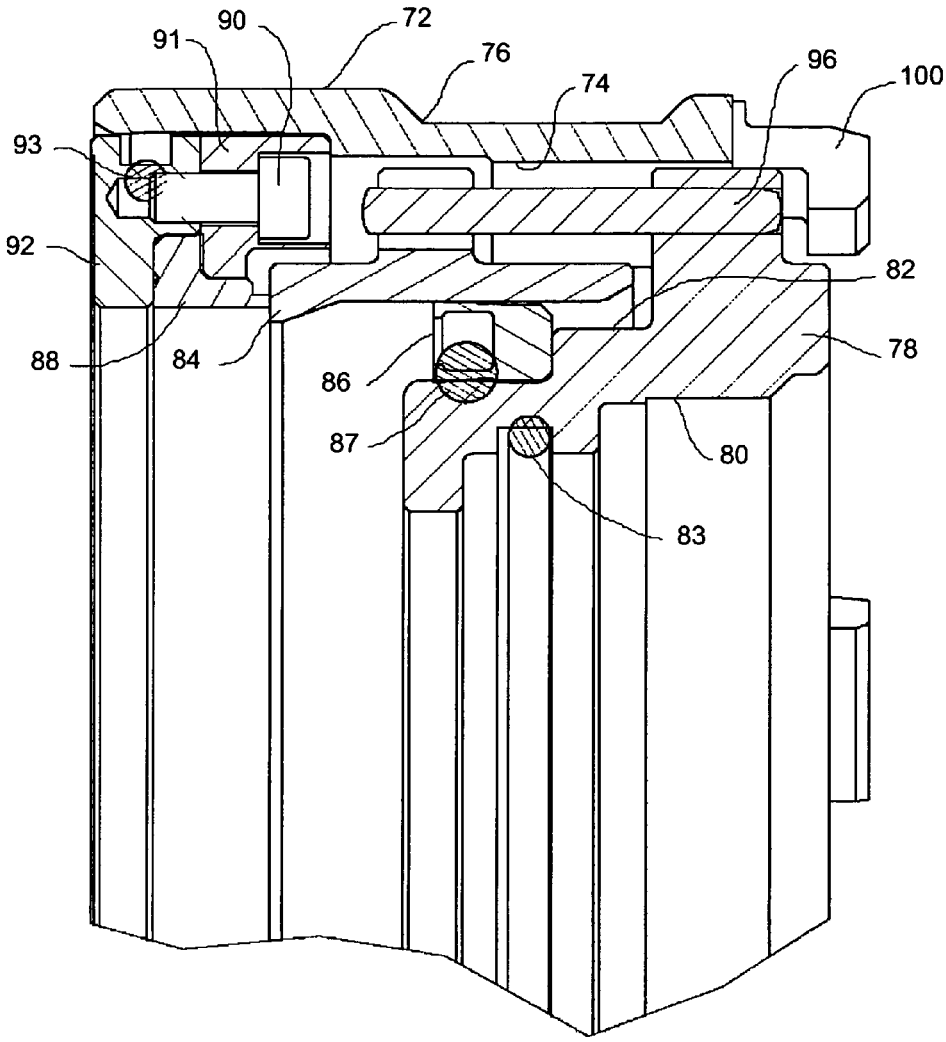
FIG. 6 is a detailed side elevation view of the seal cartridge illustrated in FIG. 5, as taken from detail A in FIG. 4.

Referring now to FIGS. 5 and 6, seal cartridge 54 includes an outer sleeve 72 adapted to engage interior surface 46 of rotatable portion 32 of abrasives conduit 24. As shown, outer sleeve 72 is engaged by overlapping portion 50. Outer sleeve 72 has an interior surface 74 and an exterior surface 76. An inner sleeve 78, having an interior surface 80 and an exterior surface 82, is telescopically received within outer sleeve 72 and is adapted to engage exterior surface 34 of fixed portion 30, with an o-ring 83 sealing the connection between inner sleeve 78 and fixed portion 30. An outer sealing element 84 is mounted to interior surface 74 of outer sleeve 72, and an inner sealing element 86 with an o-ring 87 is mounted to exterior surface 82 of inner sleeve 78. Other seals are included to contain the pressurized abrasives, such as seal 88. Seal cartridge 54 is held together and stabilized using screws connected through a retainer 91 to a holder 92 with an o-ring 93 on one side, pins 94 and 96 on the other, where pin 94 engages a spring 98, and housing seals 100. Pin 96 and spring 98 engage outer sealing element 84. It is preferable to use components with a Teflon face.

Operation:

The use and operation of hand held abrasive blaster 10 will now be described with reference to FIGS. 1 to 6. Referring to FIG. 1, a pressurized source of abrasives (not shown) is connected to hose connection 58 of hand held abrasive blaster 10 at rearward hose attachment end 40. Referring to FIG. 2, abrasives are then forced through first and second interior bores 38 and 48 in fixed portion 30 and rotatable portion 32 of abrasives conduit 24, respectively, and, referring to FIG. 3, out through forward end nozzle 52 and diverging nozzles 56. As it is desirable to have a more uniform spray, referring to FIG. 4, rotatable portion 32 is rotated by motor 62. Motor 62 has a driving gear 64 that engages a driven gear 66 that is positioned around the circumference of exterior surface 68 of overlying rearward end 28 of rotatable portion 32. Seal cartridge 54 as shown in FIG. 5 and described above is used to connect fixed portion 30 and rotatable portion 32.

Figure 7:
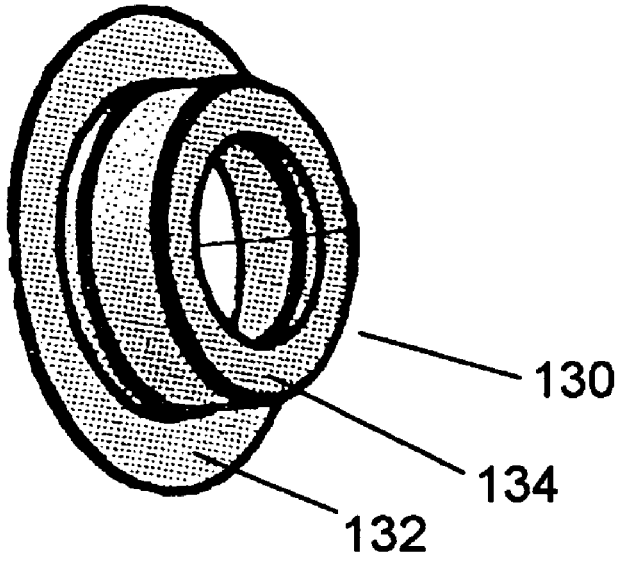
FIG. 7 is a perspective view of a dust filter.
Figure 8:
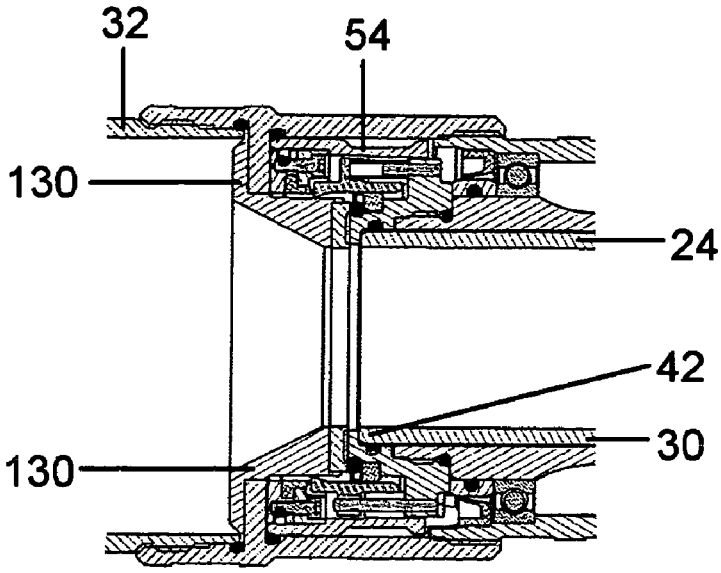
FIG. 8 is a detailed side elevation view of the rearward end of the housing of the hand held abrasive blaster illustrated in FIG. 4, with the dust filter in position.

Cautionary Warning:

In initial testing of the prototype of hand held abrasive blaster 10, it was determined that fine dust particles associated with abrasive blasting were infiltrating the cartridge seal and bearings. Referring to FIG. 7, in order to address this problem a dust trap, generally indicated by reference numeral 130, was added. Dust trap 130 has an aluminum body 132. A felt covering 134, covers body 132. Felt covering is coated with grease. The grease on felt covering 134 attracts and holds fine dust particles so that they do not infiltrated into the cartridge seal and bearings. The positioning of dust trap 130 is shown in FIG. 8. This positioning is forward of replaceable seal cartridge 54 at the transition between forwardly projecting end 42 of fixed portion 30 of abrasives conduit 24 and rotatable portion 32.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A hand held abrasive blaster, comprising: a tubular wand housing having a forward end, a rearward end, an exterior surface, and an interior surface defining an interior bore;

an abrasive conduit extending into the wand housing, the abrasives conduit having a forward end and a rearward end, the abrasives conduit having a fixed portion at the rearward end and a rotatable portion at the forward end, the fixed portion having an exterior surface, an interior surface defining a first interior bore, a rearward hose attachment end, and a forwardly projecting end, the rotatable portion telescopically overlying the forwardly projecting end of the fixed portion, the rotatable portion having an exterior surface, an interior surface defining a second interior bore co-axial with the first interior bore, an overlying rearward end and a forward nozzle end;

bearings being disposed between the exterior surface of the fixed portion of the abrasives conduit and the interior surface of the rotatable portion of the abrasives conduit;

a seal being disposed at the transition between the forwardly projecting end of the fixed portion of the abrasives conduit and the rotatable portion;

a dust trap forward of the bearings and the seal, and the dust trap being adapted to capture fine dust particles associated with use of dry abrasives and prevent such fine dust particles from infiltrating the bearings and the seal;

diverging nozzles being positioned at the forward nozzle end of the rotatable portion of the abrasives conduit;

a hose connection adapted for connecting the abrasives conduit to a source of abrasives under pressure positioned at the rearward hose attachment end of the fixed portion of the abrasives conduit;

a motor mounted in parallel spaced relation to the rearward end of the abrasives conduit, the motor having a driving gear that engages a driven gear positioned around the circumference of the exterior surface of the overlying rearward end of the rotatable portion the abrasives conduit, such that the driving gear of the motor imparts a motion to the driven gear to rotate the rotatable portion of the abrasives conduit within the wand housing; and a pair of spaced apart handles on the exterior surface of the wand housing, the handles being positioned along the exterior of the wand housing forward of the rearward end at a center of gravity for the wand housing, such that weight provided by the motor at the rearward end of the wand housing is counter-balanced by weight provided by that portion of the wand housing extending forward of the handles.

2. The hand held abrasive blaster as defined in claim 1, wherein the seal is in the form of a replaceable seal cartridge.

3. The hand held abrasive blaster as defined in claim 2, wherein the seal cartridge is comprised of:

an outer sleeve adapted to engage the interior surface of the rotatable portion of the abrasives conduit, the outer sleeve having an interior surface and an exterior surface;

an inner sleeve telescopically received within the outer sleeve and adapted to engage the exterior surface of the fixed portion, the inner sleeve having an interior surface and an exterior surface;

an outer sealing element mounted to the interior surface of the outer sleeve;

an inner sealing element mounted to the exterior surface of the inner sleeve.

* * * * *